US010693254B2

(12) United States Patent
Obata et al.

(10) Patent No.: US 10,693,254 B2
(45) Date of Patent: Jun. 23, 2020

(54) DUMMY PIN

(71) Applicant: Japan Aviation Electronics Industry, Limited, Tokyo (JP)

(72) Inventors: Yusuke Obata, Tokyo (JP); Hiroaki Obikane, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/391,515

(22) Filed: Apr. 23, 2019

(65) Prior Publication Data

US 2019/0356076 A1 Nov. 21, 2019

(30) Foreign Application Priority Data

May 21, 2018 (JP) ..... 2018-097268

(51) Int. Cl.
*H01R 13/443* (2006.01)
*H01R 13/52* (2006.01)

(52) U.S. Cl.
CPC ..... *H01R 13/443* (2013.01); *H01R 13/5221* (2013.01)

(58) Field of Classification Search
CPC ..... H01R 13/443
See application file for complete search history.

(56) References Cited

U.S. PATENT DOCUMENTS 794,140 A * 7/1905 Costa ..... H01R 13/443 439/148
3,171,887 A * 3/1965 Cross ..... H01R 13/5202 174/355
3,255,427 A * 6/1966 Yeiser ..... H01R 13/422 439/595
3,334,327 A * 8/1967 Anspach, Jr. ..... H01R 13/426 439/744
3,638,165 A * 1/1972 Anhalt ..... H01R 13/424 439/586

(Continued)

FOREIGN PATENT DOCUMENTS

GB 2 449 990 A 12/2008
JP 2004071200 A 3/2004
JP 2013-258117 A 12/2013

OTHER PUBLICATIONS

European Search Report based on Application No. 19170825.4-1209; dated Oct. 11, 2019.

*Primary Examiner* — Ross N Gushi
(74) *Attorney, Agent, or Firm* — Muncy, Geissler, Olds & Lowe, P.C.

(57) ABSTRACT

A dummy pin includes a pin main body that is to be inserted into the at least one terminal insertion port and is formed by molding resin, the pin main body having: a waterproof portion having a cylindrical seal surface that makes tight contact with an inner surface of the at least one seal hole by elastically compressing a part of the two or more lip portions of the waterproof member; and a falling-off prevention portion having one or more concave portions that are partially recessed from the seal surface toward the central axis and that a remaining lip portion of the two or more lip portions of the waterproof member enters, the seal surface forming a continuous surface over an entire circumferential direction of the waterproof portion.

5 Claims, 7 Drawing Sheets

(56) References Cited

U.S. PATENT DOCUMENTS 3,693,140 A * 9/1972 Nijman ..... H01R 13/052 439/825
3,989,334 A * 11/1976 Fortino ..... H01R 13/443 439/148
4,560,219 A * 12/1985 Chapelot ..... H01R 13/5221 439/272
4,632,482 A * 12/1986 Punako ..... H01R 13/422 439/271
4,927,787 A * 5/1990 Patel ..... H01H 27/04 200/506
4,993,964 A * 2/1991 Trummer ..... H01R 13/443 439/272
5,226,832 A * 7/1993 Dejardin ..... H01R 13/5213 439/274
5,387,138 A * 2/1995 O'Malley ..... H01R 13/405 439/751
5,551,892 A * 9/1996 Endo ..... H01R 13/443 439/587
5,575,694 A * 11/1996 Hawkins ..... H01R 13/35 439/218
5,704,799 A * 1/1998 Wood ..... H01R 13/52 439/271
5,707,251 A * 1/1998 Sakai ..... H01R 13/5208 439/274
5,711,685 A * 1/1998 Wood ..... H01R 13/5221 439/587
6,171,144 B1 * 1/2001 Stone ..... H01R 13/508 439/587
6,234,817 B1 * 5/2001 Hwang ..... H01R 13/6315 439/247
6,247,965 B1 * 6/2001 Cummings ..... H01R 13/4223 439/148
6,383,021 B1 * 5/2002 Murakami ..... H01R 13/5208 439/489
6,390,848 B1 * 5/2002 Murakami ..... H01R 13/443 439/148
6,527,567 B1 * 3/2003 Aguirre, Jr. ..... H01R 13/443 439/148
6,558,179 B2 * 5/2003 Nakamura ..... H01R 13/4362 439/275
6,808,418 B2 * 10/2004 Horner ..... H01R 13/443 439/587
6,929,509 B2 * 8/2005 Soriano ..... H01R 43/005 439/587
7,048,580 B2 * 5/2006 Kobayashi ..... H01R 13/5221 439/587
7,270,556 B2 * 9/2007 Mori ..... H01R 13/5208 439/272
7,338,320 B2 * 3/2008 Kobayashi ..... F16J 13/02 439/275
7,481,675 B2 * 1/2009 Patterson ..... H01R 13/5205 439/148
7,559,797 B2 * 7/2009 Shishikura ..... H01R 13/443 439/148
7,618,287 B2 * 11/2009 Hass ..... H01R 13/521 439/589
8,241,061 B2 * 8/2012 Chazottes ..... H01R 13/5213 439/272
8,251,748 B2 * 8/2012 Tyler ..... H01R 13/648 439/607.52
8,662,921 B2 * 3/2014 Kataoka ..... H01R 13/443 439/587
9,106,030 B2 * 8/2015 Zahnen ..... H01R 13/44
9,960,523 B2 * 5/2018 Kobayashi ..... H01R 13/521
10,050,370 B2 * 8/2018 Kashiwada ..... H01R 13/443
10,056,709 B2 * 8/2018 Kashiwada ..... H01R 13/44
10,090,614 B2 * 10/2018 Brantingham ..... H01R 13/5208
10,135,173 B2 * 11/2018 Kashiwada ..... H01R 13/44
10,164,353 B2 * 12/2018 Miki ..... H01R 13/521
2007/0004279 A1 * 1/2007 Mori ..... H01R 13/5208 439/587
2010/0227488 A1 * 9/2010 Lau ..... H01R 13/443 439/148
2013/0029507 A1 * 1/2013 Yang ..... H01R 13/443 439/148
2013/0316569 A1 * 11/2013 Leung ..... H01R 13/443 439/519
2014/0118891 A1 * 5/2014 Crane ..... H01R 13/443 361/657
2015/0244124 A1 * 8/2015 Azoulay ..... H01R 31/065 439/533
2016/0091008 A1 * 3/2016 Cerfeuille ..... F16B 19/10 29/451
2018/0131118 A1 * 5/2018 Kashiwada ..... H01R 13/44
2018/0159263 A1 * 6/2018 Kashiwada ..... H01R 13/443

* cited by examiner

DUMMY PIN

BACKGROUND OF THE INVENTION

The present invention relates to a dummy pin, particularly to a dummy pin that is inserted into a terminal insertion port into which a terminal is not inserted among a plurality of terminal insertion ports of a waterproof connector.

Conventionally, there is known a waterproof connector in which a seal member having a plurality of seal holes corresponding to a plurality of terminal insertion ports formed at a housing is attached to the housing so that terminals are to be inserted from the terminal insertion ports of the housing into the corresponding terminal accommodating portions in the housing through the seal holes of the seal member.

In a waterproof connector of this type, when a terminal insertion port into which no terminal is inserted is present among the plurality of terminal insertion ports, it is necessary to fill the terminal insertion port into which no terminal is inserted in order to prevent water intrusion into the waterproof connector.

To cope with it, for example, JP 2004-71200 A discloses a dummy pin 1 made of resin for filling a terminal insertion port as shown in FIG. 15. The dummy pin 1 has a cylindrical seal portion 3 projecting forward from a rectangular parallelepiped main body 2, hook portions 4 respectively projecting on an upper surface and a lower surface of the main body 2, and a flange portion 5 formed at a rear portion of the main body 2.

As shown in FIG. 16, a waterproof connector 6 has a structure that a seal member 8 is disposed in a concave portion 7B communicating with a terminal accommodating portion 7A of a housing 7 and a cover 9 is attached to a rear end of the housing 7. When the dummy pin 1 is inserted into a terminal insertion port 9A formed in the cover 9, the seal portion 3 of the dummy pin 1 is fitted into a seal hole 8A of the seal member 8, which prevents water intrusion to the terminal accommodating portion 7A.

Further, when the dummy pin 1 is firmly pushed into the waterproof connector 6, the hook portions 4 of the dummy pin 1 go over projections 9B respectively projecting on an upper edge and a lower edge of the terminal insertion port 9A of the cover 9 and accordingly, the projections 9B are positioned between the hook portions 4 and the flange portion 5 of the dummy pin 1, which prevents the dummy pin 1 from falling off the waterproof connector 6.

However, since the dummy pin 1 disclosed by JP 2004-71200 A is prevented from falling off by making the hook portions 4 respectively projecting on the upper surface and the lower surface of the main body 2 catch on the projections 9B respectively projecting on the upper edge and the lower edge of the terminal insertion port 9A of the cover 9, the dummy pin 1 cannot be inserted into the waterproof connector 6 in a normal manner unless the hook portions 4 project in the particular direction, i.e., the vertical direction.

Further, there is a problem in that the structure of the waterproof connector 6 becomes complicated since in order to prevent the dummy pin 1 from falling off, it is necessary not only to form the hook portions 4 projecting on the dummy pin 1 but also to form the projections 9B projecting on the upper edge and the lower edge of the terminal insertion port 9A of the cover 9 which is a component of the waterproof connector 6.

Further, in order to mold resin into the dummy pin 1 having the structure that the hook portions 4 respectively project on the upper surface and the lower surface of the main body 2 as shown in FIG. 15, it is necessary to use a metal mold that is divided in a direction perpendicular to a central axis along which the seal portion 3 of the dummy pin 1 extends to take out the dummy pin 1 from the metal mold after molding.

Therefore, due to the divided surface of the metal mold, a parting line along the central axis direction is generated on an outer peripheral surface of the seal portion 3 after molding, whereby the outer peripheral surface of the seal portion 3 cannot form a continuous surface over the whole circumference thereof. Since the parting line causes formation of projections, bumps and the like, even if the dummy pin 1 as above is inserted into the waterproof connector 6, tight contact between an inner surface of the seal hole 8A of the seal member 8 and the seal portion 3 of the dummy pin 1 in the waterproof connector 6 becomes insufficient, which may degrade waterproof properties.

SUMMARY OF THE INVENTION

The present invention has been made to eliminate the conventional drawback as above and is aimed at providing a dummy pin that can achieve excellent waterproof properties without a complicated structure of a waterproof connector and regardless of a direction of insertion to the waterproof connector.

A dummy pin according to the present invention is one for use in a waterproof connector, the waterproof connector including: a housing that has at least one terminal insertion port; and a waterproof member that is elastically deformable, is disposed in the housing and has at least one seal hole corresponding to the at least one terminal insertion port and having a central axis, the at least one seal hole having two or more lip portions that annularly project toward the central axis and are aligned in a direction of the central axis, the dummy pin comprising:

a pin main body that is to be inserted into the at least one terminal insertion port and is formed by molding resin, wherein the pin main body has: a waterproof portion having a cylindrical seal surface that makes tight contact with an inner surface of the at least one seal hole by elastically compressing a part of the two or more lip portions of the waterproof member; and a falling-off prevention portion having one or more concave portions that are partially recessed from the seal surface toward the central axis and that a remaining lip portion of the two or more lip portions of the waterproof member enters, and the seal surface forms a continuous surface over an entire circumferential direction of the waterproof portion.

DETAILED DESCRIPTION OF THE INVENTION

Embodiments of the present invention are described below based on the appended drawings.

Embodiment 1

Figure 1:
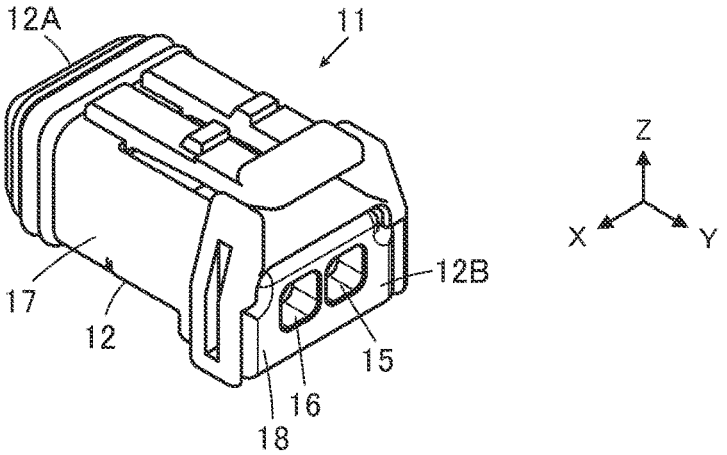
FIG. 1 is a perspective view showing a waterproof connector.
Figure 2:
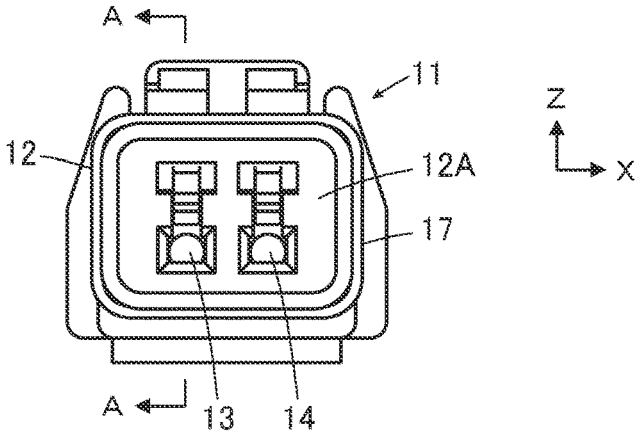
FIG. 2 is a front view showing the waterproof connector.

FIGS. 1 and 2 show a waterproof connector 11 to which a dummy pin according to the present invention is applied. The waterproof connector 11 has a housing 12 formed of resin, two front face opening portions 13 and 14 into each of which a terminal of a counter connector (not shown) is inserted during fitting with the counter connector are formed on a front face 12A of the housing 12, and two terminal insertion ports 15 and 16 open at a rear face 12B opposite to the front face 12A.

The housing 12 is constituted of a housing main body 17 and a rear cover 18 disposed at a rear portion of the housing main body 17. The housing main body 17 has the front face opening portions 13 and 14, and the rear cover 18 has the terminal insertion ports 15 and 16.

For convenience, the direction which extends from the front face 12A to the rear face 12B of the housing 12 is called "+Y direction," the direction in which the two terminal insertion ports 15 and 16 are aligned is called "X direction," and the direction perpendicular to an XY plane is called "Z direction." The counter connector (not shown) is fitted into the waterproof connector 11 from the −Y direction to the +Y direction.

Figure 3:
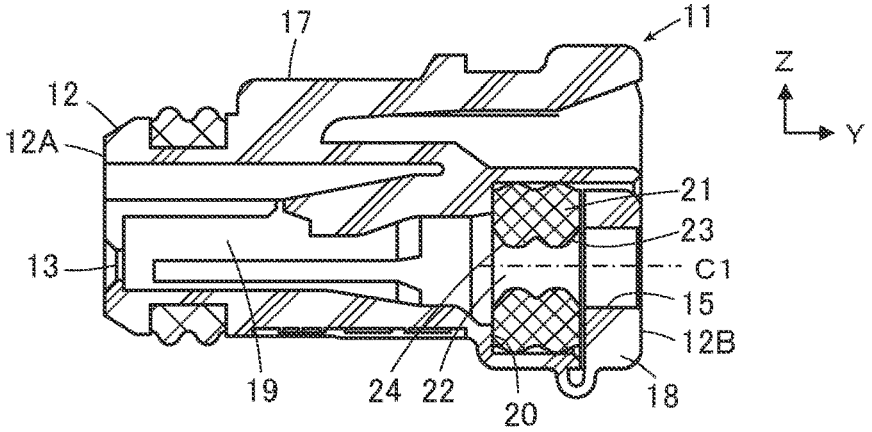
FIG. 3 is a cross-sectional view taken along line A-A in FIG. 2.

FIG. 3 is a cross-sectional side view of the waterproof connector 11 cut at a position of the terminal insertion port 15. A terminal accommodating portion 19 of recess shape communicating with the terminal insertion port 15 is formed inside the housing main body 17.

A concave portion 20 is formed inside the housing main body 17 so as to be adjacent to the +Y direction side of the terminal accommodating portion 19, and a waterproof member 21 is disposed in the concave portion 20. The waterproof member 21 is made of, for example, an elastically deformable material such as a rubber material, and a seal hole 22 communicating with the terminal insertion port 15 and having a central axis C1 is formed in the waterproof member 21. Two lip portions 23 and 24 that annularly project toward the central axis C1 and are aligned in the direction of the central axis C1 are formed inside the seal hole 22.

Each of the two lip portions 23 and 24 has an inside diameter smaller than that of the terminal insertion port 15 of the rear cover 18, and the lip portion 23 is positioned closer to the rear face 12B side, i.e., the +Y direction side of the housing 12 than the lip portion 24 is.

The waterproof member 21 is held in the concave portion 20 by fixing the rear cover 18 to the rear portion of the housing main body 17.

Although not shown in FIG. 3, as with the terminal accommodating portion 19 communicating with the terminal insertion port 15, a terminal accommodating portion 19 communicating with the terminal insertion port 16 is also formed inside the housing main body 17, and as with the seal hole 22 communicating with the terminal insertion port 15, a seal hole 22 communicating with the terminal insertion port 16 is also formed in the waterproof member 21, and two lip portions 23 and 24 are formed inside the seal hole 22 communicating with the terminal insertion port 16. In other words, the two terminal accommodating portions 19 are formed inside the housing main body 17 and the two seal holes 22 are formed in the waterproof member 21 such that the portions 19 and the holes 22 correspond to the two terminal insertion ports 15 and 16.

Figure 4:
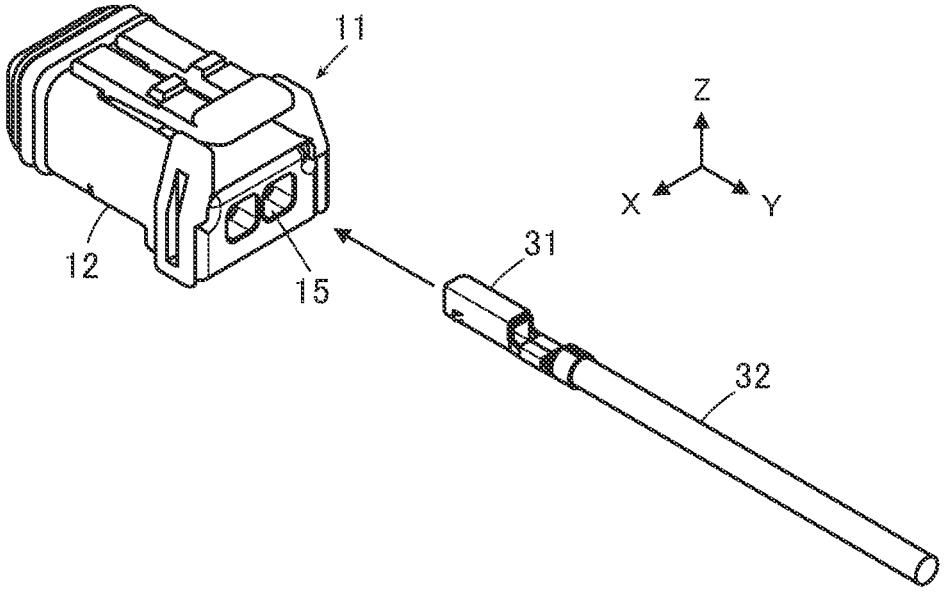
FIG. 4 is a perspective view showing the state where a terminal is being inserted into the waterproof connector.

As shown in FIG. 4, a terminal 31 used in the waterproof connector 11 is connected to an end of an electrical wire 32 and is attached to the inside of the waterproof connector 11 by inserting the terminal 31 in the −Y direction from, for example, the terminal insertion port 15 of the waterproof connector 11. The electric wire 32 is set to have an outside diameter larger than each of the inside diameters of the two lip portions 23 and 24 of the waterproof member 21.

Figure 5:
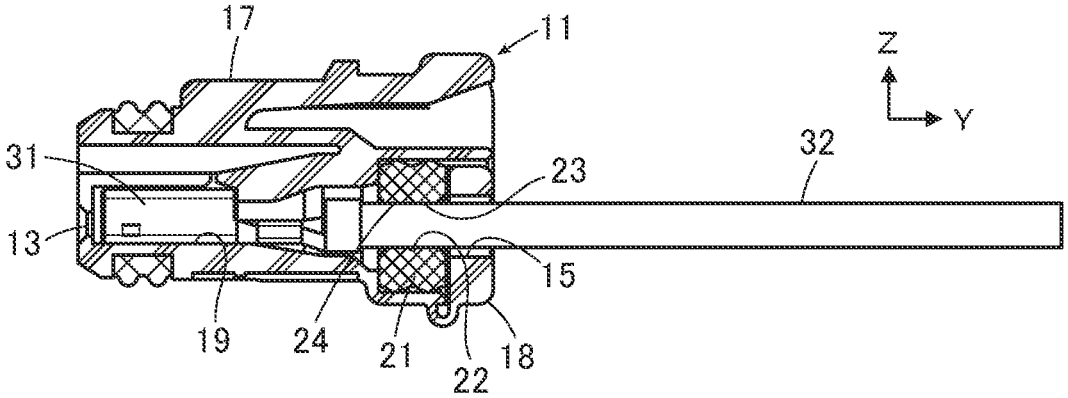
FIG. 5 is a cross-sectional side view showing the waterproof connector into which the terminal is inserted.

When the terminal 31 is inserted in the −Y direction from the terminal insertion port 15 of the waterproof connector 11, the terminal 31 passes through the seal hole 22 of the waterproof member 21 from the terminal insertion port 15 and is accommodated in the terminal accommodating portion 19 in the housing main body 17 as shown in FIG. 5. At this time, the electric wire 32 connected to the terminal 31 is inserted into the seal hole 22 of the waterproof member 21 and makes tight contact with an inner surface of the seal hole 22 while elastically compressing the two lip portions 23 and 24 projecting in the seal hole 22. This prevents water intrusion to the terminal accommodating portion 19 through the terminal insertion port 15.

The terminal 31 shown in FIGS. 4 and 5 is a receptacle terminal, and a plug terminal of the counter connector (not shown) is inserted into the terminal 31 through the front face opening portion 13 during a fitting process with the counter connector, whereby the counter connector is electrically connected to the terminal 31.

When the terminal 31 is thus inserted into each of the two terminal insertion ports 15 and 16 of the waterproof connector 11, the electrical wire 32 connected to the terminal 31 is fitted into each of the two seal holes 22 formed in the waterproof member 21, which prevents water intrusion into the waterproof connector 11. However, when the terminal 31 is inserted into the only terminal insertion port 15, i.e., only one of the two terminal insertion ports 15 and 16, with the other terminal insertion port 16 being not used and the terminal 31 being not inserted into the terminal insertion port 16, it is necessary to fill the terminal insertion port 16 in order to prevent water intrusion into the waterproof connector 11.

Figure 6:
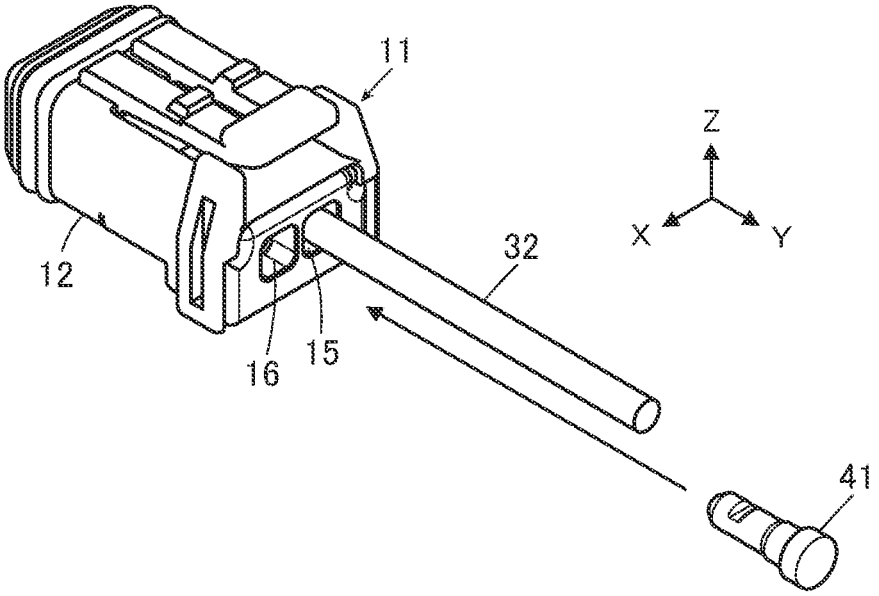
FIG. 6 is a perspective view showing the state where a dummy pin according to Embodiment 1 is being inserted into the waterproof connector.

To cope with it, as shown in FIG. 6, a dummy pin 41 according to Embodiment 1 is inserted into the terminal insertion port 16 of the waterproof connector 11.

Figure 7:
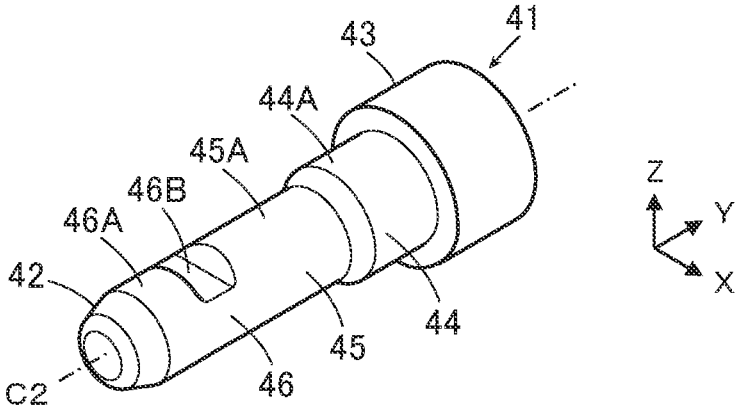
FIG. 7 is a perspective view showing the dummy pin according to Embodiment 1.
Figure 8:
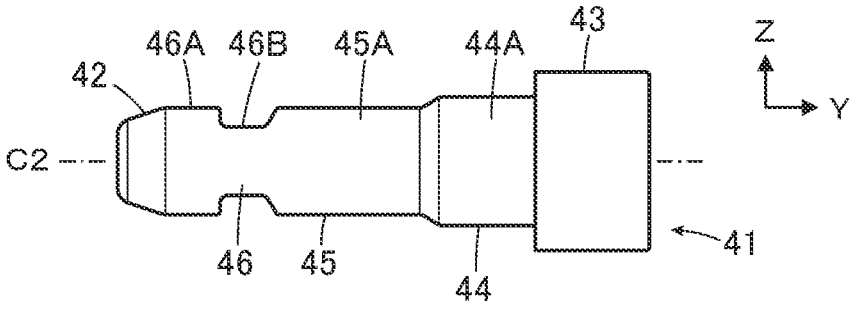
FIG. 8 is a side view showing the dummy pin according to Embodiment 1.

As shown in FIGS. 7 and 8, the dummy pin 41 is a pin-shaped member extending along a central axis C2 and is produced by resin molding. The dummy pin 41 is constituted of a pin main body 42 and a head portion 43 joined to one end in the length direction of the pin main body 42, i.e, the +Y direction end of the pin main body 42.

The pin main body 42 is accommodated in the housing 12 of the waterproof connector 11 when the dummy pin 41 is inserted into the terminal insertion port 16 of the waterproof connector 11, and the pin main body 42 has a fitting portion 44, a waterproof portion 45 and a falling-off prevention portion 46 that are sequentially aligned from +Y direction end connected to the head portion 43 toward the −Y direction end.

The waterproof portion 45 has a cylindrical seal surface 45A. The seal surface 45A has an outside diameter larger than the inside diameter of each of the lip portions 23 and 24 of the waterproof member 21 disposed in the waterproof connector 11 and forms a continuous surface over the entire circumferential direction of the waterproof portion 45. When the dummy pin 41 is inserted into the terminal insertion port 16 of the waterproof connector 11, the seal surface 45A is inserted into the seal hole 22 of the waterproof member 21 and make tight contact with the inner surface of the seal hole 22 by elastically compressing, of the two lip portions 23 and 24 formed inside the seal hole 22, the lip portion 23 that is positioned on the +Y direction side.

The falling-off prevention portion 46 is disposed adjacent to the −Y direction side of the waterproof portion 45. The falling-off prevention portion 46 has a cylindrical outer peripheral surface 46A that is continuous with the seal surface 45A of the waterproof portion 45 and that has an outer diameter equal to that of the seal surface 45A, and a pair of concave portions 46B that are formed at the outer peripheral surface 46A so as to face in opposite directions to each other in a direction perpendicular to the central axis C2 of the dummy pin 41. When the dummy pin 41 is inserted into the terminal insertion port 16 of the waterproof connector 11, of the two lip portions 23 and 24 of the waterproof member 21, the lip portion 24 positioned on the −Y direction side enters the pair of concave portions 46B, which prevents the dummy pin 41 from falling off. As shown in FIG. 8, the +Y direction end surface of the concave portion 46B is inclined in an obtuse angle direction with respect to the bottom surface of the concave portion 46B, and the −Y direction end surface of the concave portion 46B is upright to the bottom surface of the concave portion 46B.

Thus, the pin main body 42 is configured such that a portion thereof positioned on the −Y direction side of the waterproof portion 45 has an outside diameter equal to or smaller than that of the seal surface 45A.

The fitting portion 44 has a cylindrical outer peripheral surface 44A having an outside diameter larger than that of the seal surface 45A of the waterproof portion 45 and slightly smaller than the inside diameter of the terminal insertion port 16, and when the dummy pin 41 is inserted into the terminal insertion port 16 of the waterproof connector 11, the fitting portion 44 is fitted with the terminal insertion port 16.

The head portion 43 joined to the +Y direction end of the pin main body 42 has an outside diameter larger than the inside diameter of the terminal insertion port 16 of the waterproof connector 11, and when the dummy pin 41 is inserted into the terminal insertion port 16 of the waterproof connector 16, the head portion 43 functions as a stopper that comes into contact with the rear face 12B of the housing 12 at which the terminal insertion port 16 opens.

Figure 9:
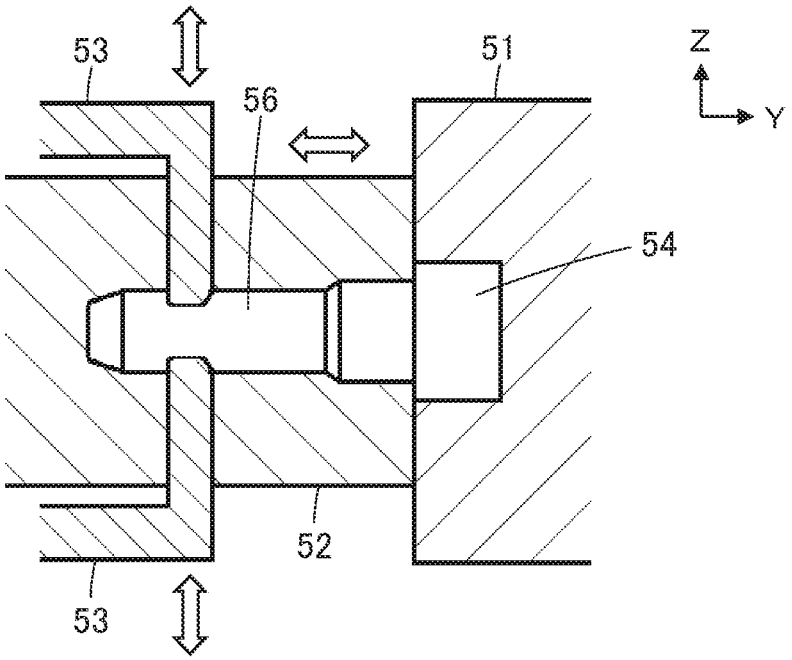
FIG. 9 is a cross-sectional side view showing a shape-forming mold for molding the dummy pin according to Embodiment 1.

The dummy pin 41 as above can be produced by resin molding using a shape-forming mold as shown in FIG. 9, for example.

The shape-forming mold is constituted of a fixed mold 51, a movable mold 52 that is disposed to be movable in the Y direction with respect to the fixed mold 51, and a pair of slide molds 53 that are incorporated in the movable mold 52 and slide in the Z direction in response to the movement of the movable mold 52.

The fixed mold 51 has a cavity 54 corresponding to the head portion 43 of the dummy pin 41 and a gate (not shown) for injecting molten resin R in the cavity 54.

The movable mold 52 has a cavity 56 corresponding to the pin main body 42 of the dummy pin 41. In other words, the parting plane between the fixed mold 51 and the movable mold 52 is set at the boundary between the pin main body 42 and the head portion 43, the boundary being perpendicular to the central axis C2 of the dummy pin 41.

Tip ends of the pair of slide molds 53 that are incorporated in the movable mold 52 have a shape corresponding to the pair of concave portions 46B of the falling-off prevention portion 46 of the dummy pin 41, and as shown in FIG. 9, when the movable mold 52 comes into contact with the fixed mold 51 so as to close the shape-forming mold, each of the slide molds 53 advances toward the cavity 56 of the movable mold 52 and the tip ends of the slide molds 53 project in the cavity 56 of the movable mold 52. On the other hand, when the movable mold 52 separates from the fixed mold 51 so as to open the shape-forming mold, each of the slide molds 53 is retracted from the cavity 56 of the movable mold 52, and the tip ends of the slide molds 53 move away from the cavity 56 of the movable mold 52.

As shown in FIG. 9, in the state where the cavity 54 of the fixed mold 51 and the cavity 56 of the movable mold 52 are connected to each other by closing the shape-forming mold as above, the molten resin R is injected into the cavities 54 and 56 through the gate (not shown) in the fixed mold 51. After the resin is cooled and solidified, the shape-forming mold is opened by moving the movable mold 52 in the −Y direction. At this time, since the pair of slide molds 53 are retracted from the cavity 56 of the movable mold 52, the dummy pin 41 thus molded can be extracted by being pulled out in the Y direction from the fixed mold 51 and the movable mold 52.

Thus, a parting line caused by molding is not generated on the seal surface 45A of the waterproof portion 45, whereby the dummy pin 41 in which the seal surface 45 forms a continuous surface over the entire circumferential direction of the waterproof portion 45 can be produced.

By reversing the fixed mold 51 and the movable mold 52, a shape-forming mold can be constituted of a movable mold having the cavity 54 and a fixed mold having the cavity 56.

Figure 10:
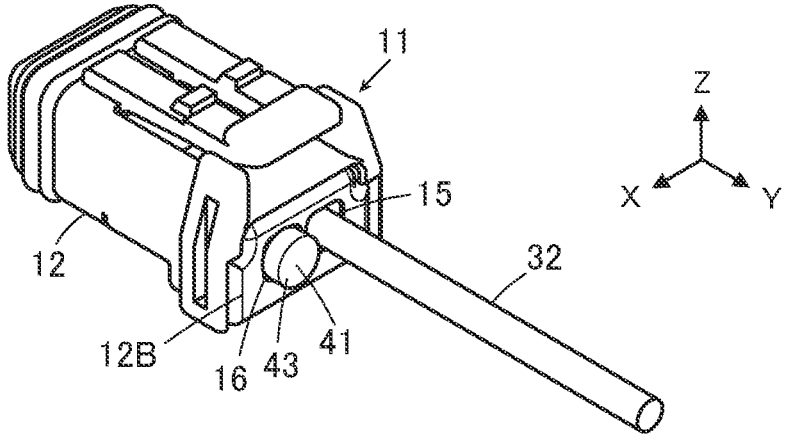
FIG. 10 is a perspective view showing the waterproof connector into which the dummy pin is inserted.

FIG. 10 shows the waterproof connector 11 in which the dummy pin 41 is inserted in the terminal insertion port 16. The terminal 31 not shown in FIG. 10 is inserted in one of the two terminal insertion ports 15 and 16 of the waterproof connector 11, i.e., the terminal insertion port 15, the electric wire 32 connected to the terminal 31 is led out from the terminal insertion port 15, and the dummy pin 41 is inserted in the other port, i.e., the terminal insertion port 16. The head portion 43 of the dummy pin 41 is in contact with the rear face 12B of the housing 12.

Figure 11:
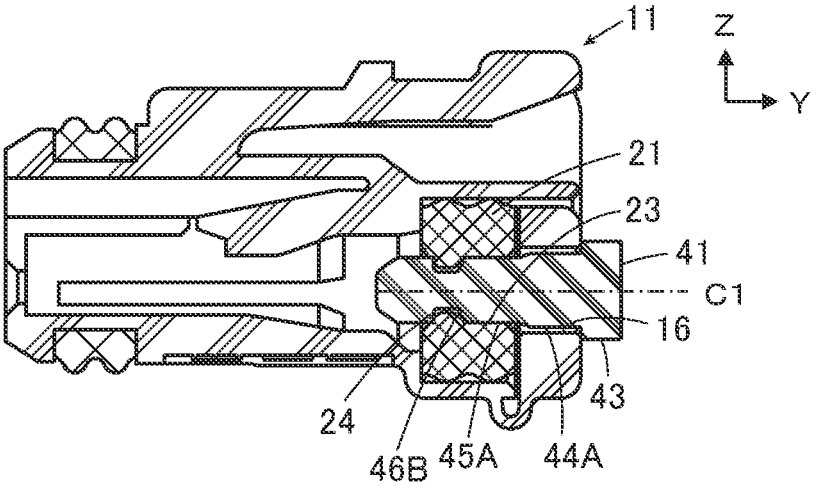
FIG. 11 is a cross-sectional side view showing the waterproof connector into which the dummy pin is inserted.

As shown in FIG. 11, when the dummy pin 41 is inserted into the terminal insertion port 16, the falling-off prevention portion 46 and the waterproof portion 45 of the dummy pin 41 are inserted into the seal hole 22 of the waterproof member 21 and the fitting portion 44 of the dummy pin 41 is fitted with the terminal insertion port 16.

When the pair of concave portions 46B of the falling-off prevention portion 46 of the dummy pin 41 move in the −Y direction while going over the lip portion 23 of the +Y direction side of the waterproof member 21 and the lip portion 24 of the −Y direction side of the waterproof member 21 enters the pair of concave portions 46B of the falling-off prevention portion 46 of the dummy pin 41, the head portion 43 comes into contact with the rear face 12B of the housing 12. Thus, the insertion of the dummy pin 41 to the terminal insertion hole 16 is completed.

At this time, since the seal surface 45A of the waterproof portion 45 of the dummy pin 41 is located at a position of the lip portion 23 of the +Y direction side of the waterproof member 21 and has an outside diameter larger than the inside diameter of the lip portion 23, the seal surface 45A makes tight contact with the inner surface of the seal hole 22 by elastically compressing the lip portion 23. This prevents water intrusion into the housing 12 through the terminal insertion port 16.

Since the seal surface 45A of the waterproof portion 45 of the dummy pin 41 does not have a parting line caused by resin molding and forms a continuous surface over the entire circumferential direction of the waterproof portion 45, the inner surface of the seal hole 22 of the waterproof member 21 and the seal surface 45A of the dummy pin 41 makes sufficiently tight contact with each other, thus achieving excellent waterproof properties.

Since the lip portion 24 of the −Y direction side of the waterproof member 21 enters the pair of concave portions 46B of the falling-off prevention portion 46 of the dummy pin 41, the dummy pin 41 is prevented from falling off the waterproof connector 11, whereby a waterproof function by the dummy pin 41 is maintained.

Since the −Y direction end surface of the concave portion 46B formed in the falling-off prevention portion 46 of the dummy pin 41 is upright to the bottom surface of the concave portion 46B as described above, even if an external force that attempts to pull the dummy pin 41 out toward the +Y direction is applied to the dummy pin 41, the −Y direction end surface of the concave portion 46B catches on the lip portion 24 of the waterproof member 21, which effectively prevents pull-out of the dummy pin 41. Therefore, even if the internal pressure of the waterproof connector 11 rises, the dummy pin 41 can be prevented from falling off the terminal insertion port 16 and thus water intrusion into the waterproof connector 11 can be prevented.

Further, the dummy pin 41 includes the fitting portion 44 having the cylindrical outer peripheral surface 44A, the waterproof portion 45 having the cylindrical seal surface 45A, and the falling-off prevention portion 46 having the cylindrical outer peripheral surface 46A and the pair of concave portions 46B formed on the outer peripheral surface 46A, and the annular lip portion 24 of the waterproof member 21 of the waterproof connector 11 enters the concave portions 46B of the falling-off prevention portion 46 of the dummy pin 41; therefore, the dummy pin 41 can be inserted into the terminal insertion port 16 of the waterproof connector 11 in a normal manner irrespective of the angle position around the central axis C2 of the dummy pin 41. In other words, even if the dummy pin 41 is positioned in any direction around the central axis C2, the dummy pin 41 can be inserted into the terminal insertion port 16 of the waterproof connector 11 to prevent water intrusion into the waterproof connector 11 and generate a falling-off prevention function.

Figure 12:
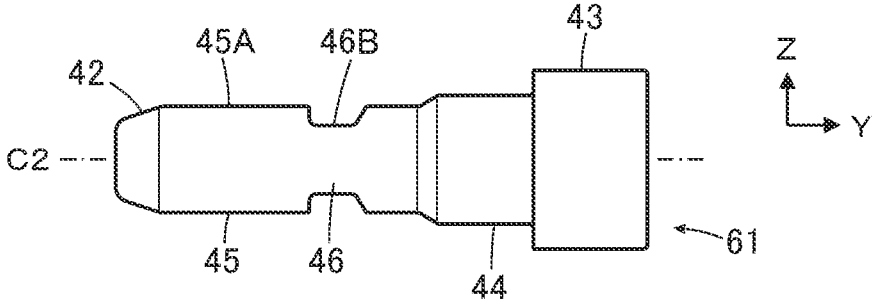
FIG. 12 is a side view showing a dummy pin according to a variation of Embodiment 1.

While the dummy pin 41 shown in FIGS. 7 and 8 has the fitting portion 44, the waterproof portion 45 and the falling-off prevention portion 46 that are sequentially aligned from the +Y direction end connected to the head portion 43 toward the −Y direction end, like a dummy pin 61 shown in FIG. 12, the waterproof portion 45 may be positioned on the −Y direction side of the falling-off prevention portion 46 such that, from the head portion 43, the fitting portion 44, the falling-off prevention portion 46 and the waterproof portion 45 are sequentially aligned.

When this dummy pin 61 is inserted into the terminal insertion port 16 of the waterproof connector 11, the seal surface 45A of the waterproof portion 45 makes tight contact with the inner surface of the seal hole 22 by elastically compressing the lip portion 24 of the −Y direction side of the waterproof member 21, and the lip portion 23 of the +Y direction side of the waterproof member 21 enter the concave portion 46B of the falling-off prevention portion 46, which prevents the dummy pin 61 from falling off.

While, in the dummy pins 41 and 61, the falling-off prevention portion 46 has the pair of concave portions 46B facing the opposite directions with each other, the invention is not limited thereto; even when the falling-off prevention portion 46 has only one concave portion 46B, the lip portion 23 or 24 of the waterproof member 21 enters this concave portion 46B, which prevents the dummy pins 41 and 61 from falling off. Further, even when the falling-off prevention portion 46 has three or more concave portions 46B, the dummy pins 41 and 61 can be prevented from falling off in the same manner.

While the waterproof member 21 of the waterproof connector 11 has the two lip portions 23 and 24 projecting inside the seal hole 22, the invention is not limited thereto; the waterproof member 21 may have three or more lip portions that annularly project toward the central axis C1 and are aligned in the direction of the central axis C1 inside the seal hole 22. In this case, the seal surface 45A of the waterproof portion 45 of the dummy pin 41 or 61 makes tight contact with the inner surface of the seal hole 22 by elastically compressing a part of the three or more lip portions, and the remaining lip portion(s) of the three or more lip portions enters the concave portions 46B of the falling-off prevention portion 46 of the dummy pin 41 or 61.

While the waterproof connector 11 has the two terminal insertion ports 15 and 16, the invention is not limited thereto; the dummy pin 41 or 61 can be applied to a waterproof connector having three of more terminal insertion ports. The waterproof connector may have three or more terminal accommodating portions corresponding to the three or more terminal insertion ports in the housing, the waterproof member disposed in the housing may have three or more seal holes corresponding to the three or more terminal insertion ports, and two or more lip portions may be formed in each of the seal holes. Of the three or more terminal insertion ports of the waterproof connector, a terminal is inserted into a part of the terminal insertion ports and the dummy pin 41 or 61 is inserted into the remaining terminal insertion port(s) into which the terminal is not inserted, which prevents water intrusion into the waterproof connector.

Embodiment 2

Figure 13:
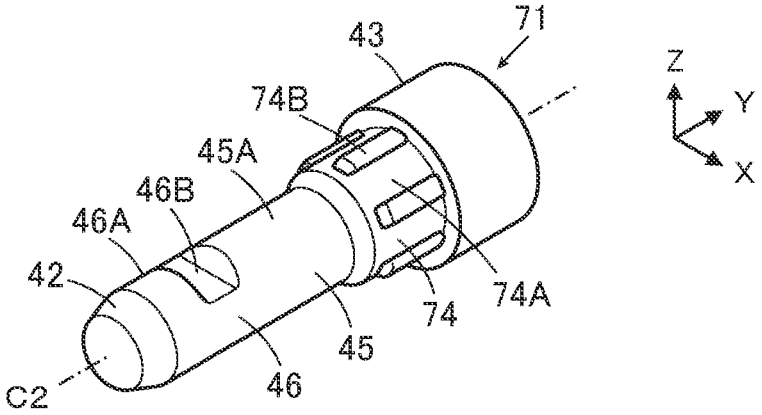
FIG. 13 is a perspective view showing a dummy pin according to Embodiment 2.
Figure 14:
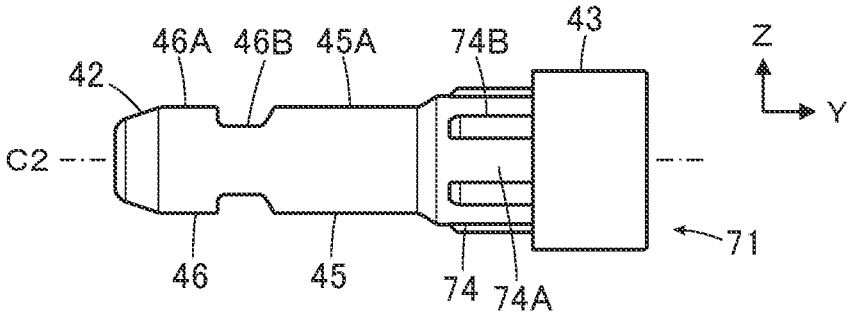
FIG. 14 is a side view showing the dummy pin according to Embodiment 2.
Figure 15:
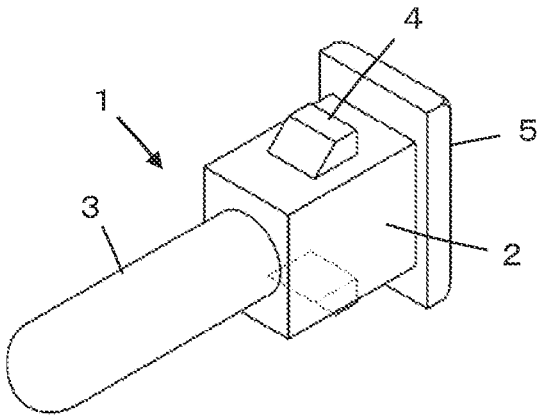
FIG. 15 PRIOR ART
FIG. 15 is a perspective view showing a conventional dummy pin.
Figure 16:
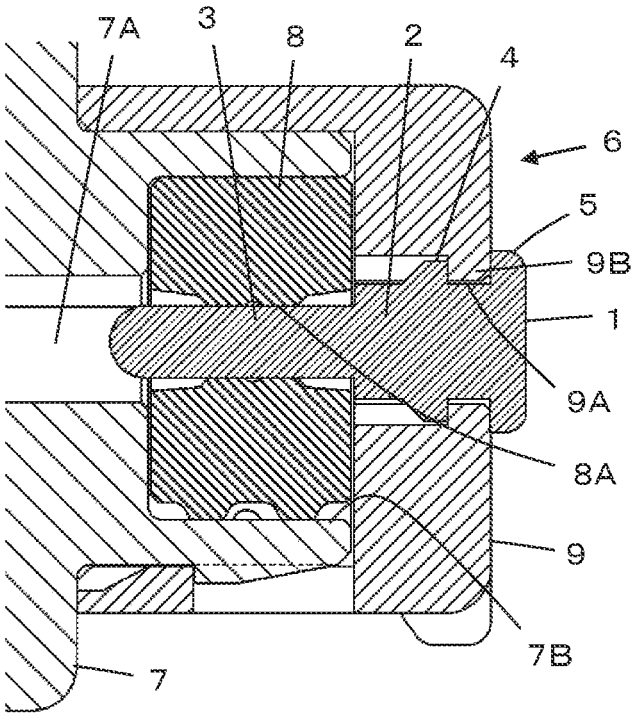
FIG. 16 PRIOR ART
FIG. 16 is a cross-sectional side view showing a waterproof connector into which the conventional dummy pin is inserted.

A dummy pin 71 according to Embodiment 2 is shown in FIGS. 13 and 14. This dummy pin 71 is obtained by disposing a fitting portion 74 instead of the fitting portion 44 between the head portion 43 and the waterproof portion 45 in the dummy pin 41 according to Embodiment 1 shown in FIGS. 7 and 8, and the other configuration is the same as that of the dummy pin 41 according to Embodiment 1. The fitting portion 74 has a cylindrical outer peripheral surface 74A having an outside diameter larger than that of the seal surface 45A of the waterproof portion 45 and slightly smaller than the inside diameter of the terminal insertion port 16 of the waterproof connector 11, and a plurality of press-fitting ribs 74B formed on the outer peripheral surface 74A.

The plurality of press-fitting ribs 74B are disposed at equal intervals in a circumferential direction of the outer peripheral surface 74A and each extend in parallel with the central axis C2 of the dummy pin 71. The top section of each of the plurality of press-fitting libs 74B, i.e., the portion most distant from the central axis C2 is positioned on a circumference having a diameter slightly larger than the inside diameter of the terminal insertion port 16 of the waterproof connector 11, and when the dummy pin 71 is inserted into the terminal insertion port 16 of the waterproof connector 11, the plurality of press-fitting ribs 74B are press-fitted into the terminal insertion port 16.

Thus, the dummy pin 71 according to Embodiment 2 has a structure which prevents the dummy pin 71 from falling off the waterproof connector 11 more efficiently than the dummy pin 41 of Embodiment 1, whereby a waterproof function by the dummy pin 71 can be reliably maintained.

While the head portion 43 of the above-described dummy pin 41, 61 or 71 has a circular cylindrical shape, the invention is not limited thereto. The head portion 43 only needs to function as a stopper when the dummy pin 41, 61 or 71 is inserted into the terminal insertion port 16 of the waterproof connector 11, and may have, for example, a polygonal column shape having a size larger than the inside diameter of the terminal insertion port 16.

By changing the method of producing the slide molds in the shape-forming mold, the shape of the concave portion partially recessed the seal surface of the dummy pin toward the central axis can be changed in various ways.

In the case where a dummy pin is molded using the shape-forming mold having the structure shown in FIG. 9, when the diameters of the cylindrical outer peripheral surface 44A of the fitting portion 44, the cylindrical seal surface 45A of the waterproof portion 45, and the cylindrical outer peripheral surface 46A of the falling-off prevention portion 46 gradually decrease toward the −Y direction, the dummy pin can readily fall off the shape-forming mold; even if the dummy pin has a shape that the diameter thereof gradually decreases toward the −Y direction, the waterproof function and the falling-off prevention function are not changed as compared with the dummy pin having a shape in which the diameter thereof does not gradually decrease.

What is claimed is:

1. A dummy pin for use in a waterproof connector, the waterproof connector including: a housing that has at least one terminal insertion port; and a waterproof member that is elastically deformable, is disposed in the housing and has at least one seal hole corresponding to the at least one terminal insertion port and having a central axis, the at least one seal hole having two or more lip portions that annularly project toward the central axis and are aligned in a direction of the central axis, the dummy pin comprising:

a pin main body that is to be inserted into the at least one terminal insertion port and is formed by molding resin, wherein the pin main body has: a waterproof portion having a cylindrical seal surface that makes tight contact with an inner surface of the at least one seal hole by elastically compressing a part of the two or more lip portions of the waterproof member; and a falling-off prevention portion having one or more concave portions that are partially recessed from the seal surface toward the central axis and that a remaining lip portion of the two or more lip portions of the waterproof member enters, and the seal surface forms a continuous surface over an entire circumferential direction of the waterproof portion, the dummy pin further comprises a head portion that is joined to one end of the pin main body in a length direction thereof and has a size larger than an inside diameter of the at least one terminal insertion port, the pin main body has a fitting portion to be fitted with the at least one terminal insertion port, the fitting portion being positioned closer to the one end of the pin main body in the length direction than the waterproof portion and having an outside diameter larger than that of the seal surface, the dummy pin further comprises at least one press-fitting rib on a surface of the fitting portion.

2. The dummy pin according to claim 1, wherein a portion of the pin main body positioned closer to the other end of the pin main body in the length direction than the waterproof portion has an outside diameter equal to or larger than that of the seal surface.

3. The dummy pin according to claim 2, wherein the falling-off prevention portion is disposed closer to the other end of the pin main body in the length direction than the waterproof portion.

4. The dummy pin according to claim 1, wherein an end surface of the concave portion closer to the head portion is inclined in an obtuse angle direction with respect to a bottom surface of the concave portion and an end surface of the concave portion farer from the head portion is upright to the bottom surface of the concave portion.

5. The dummy pin according to claim 1, wherein a portion most distant from the central axis of each of the press-fitting rib is positioned on a circumference having a diameter slightly larger than the inside diameter of the terminal insertion port of the waterproof connector.

* * * * *